US006874706B2

(12) United States Patent
Hanneke et al.

(10) Patent No.: US 6,874,706 B2
(45) Date of Patent: Apr. 5, 2005

(54) SOLENOID VALVE COMPRISING A PLUG-IN/ROTATIVE CONNECTION

(75) Inventors: Juergen Hanneke, Stuttgart (DE); Andreas Gaudl, Remshalden (DE); George Anthony, Bangalore (IN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/380,033

(22) PCT Filed: Jun. 19, 2002

(86) PCT No.: PCT/DE02/02234

§ 371 (c)(1),
(2), (4) Date: Sep. 9, 2003

(87) PCT Pub. No.: WO03/006817

PCT Pub. Date: Jan. 23, 2003

(65) Prior Publication Data

US 2004/0026645 A1 Feb. 12, 2004

(30) Foreign Application Priority Data

Jul. 10, 2001 (DE) ..... 101 33 450

(51) Int. Cl.[7] ..... F02M 47/02

(52) U.S. Cl. ..... 239/533.8; 239/533.2; 251/129.19

(58) Field of Search ..... 239/533.2, 533.8, 239/533.9, 585.1, 585.3; 251/50, 129.16, 129.1

(56) References Cited

U.S. PATENT DOCUMENTS

| | | | |
|---|---|---|---|
| 6,056,264 | A | 5/2000 | Benson et al. |
| 6,237,857 | B1 | 5/2001 | Ausman et al. |

FOREIGN PATENT DOCUMENTS

| | | |
|---|---|---|
| DE | 196 50 865 | 6/1998 |
| DE | 198 32 826 | 1/2000 |
| DE | 199 36 943 | 2/2001 |
| WO | WO 98 25025 | 6/1998 |

*Primary Examiner*—David A. Scherbel
*Assistant Examiner*—Thach H. Bui
(74) *Attorney, Agent, or Firm*—Kenyon & Kenyon

(57) ABSTRACT

A solenoid valve for a fuel injector for injecting fuel into the combustion chamber of an internal combustion engine having an injector body which includes an electromagnet. An armature group of the solenoid valve may be actuated by this electromagnet to relieve the pressure in a control chamber, so that a nozzle needle/tappet assembly in the injector body implements an opening/closing movement. The armature group includes a first and a second armature part. The first armature part and the second armature part are joined to one another by an insert-and-twist connection, one of the armature parts being enclosed by an armature guide which includes anti-rotation elements.

15 Claims, 5 Drawing Sheets

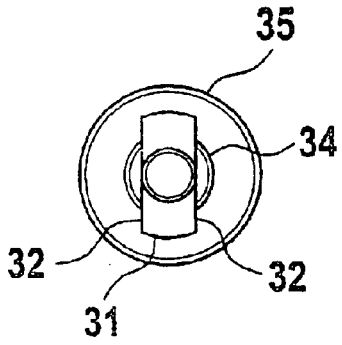
Fig. 2.1
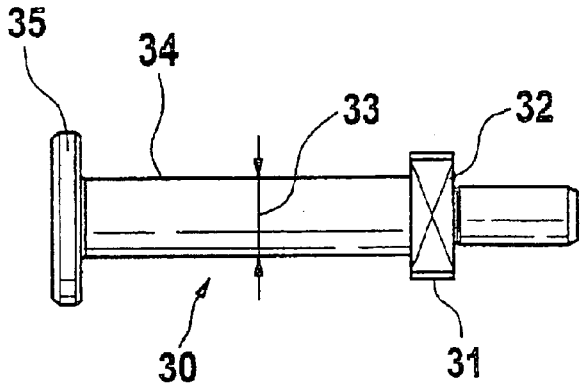
Fig. 2.2
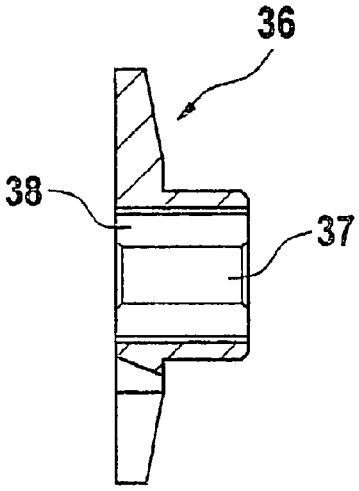
Fig. 3.1
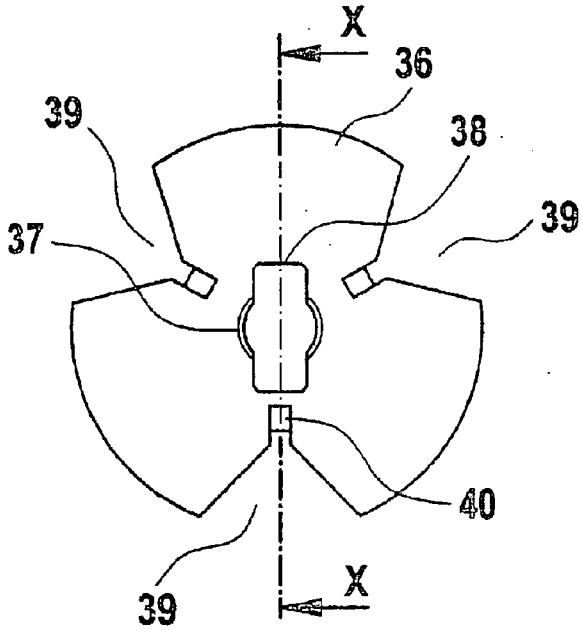
Fig. 3.2

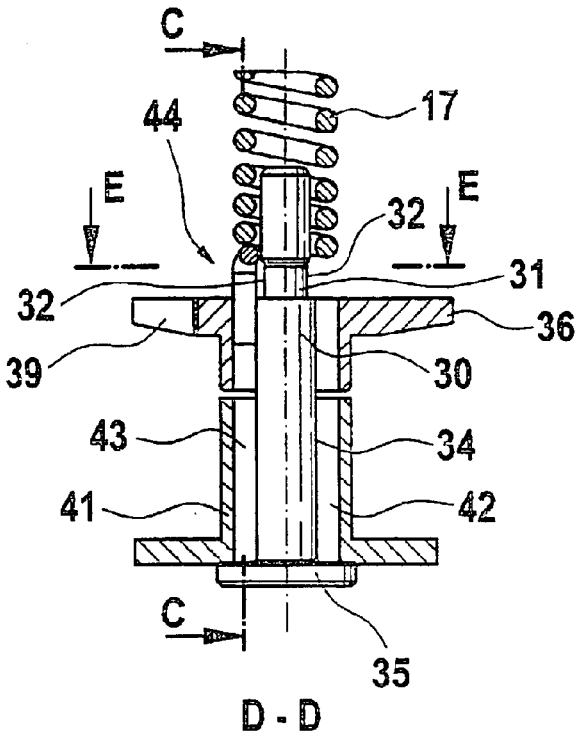
Fig. 4.1
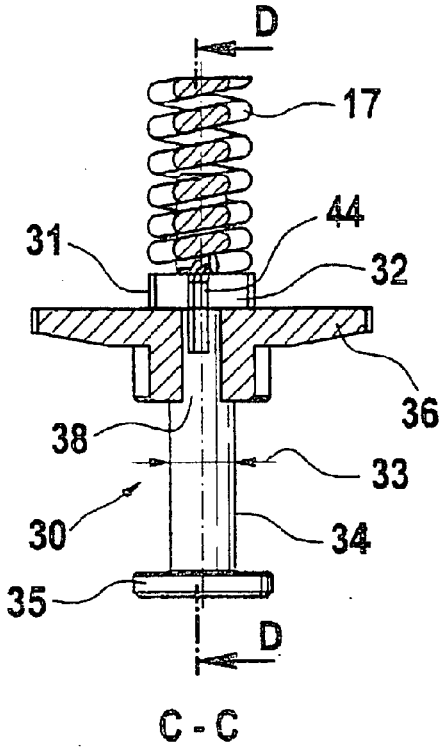
Fig. 4.2
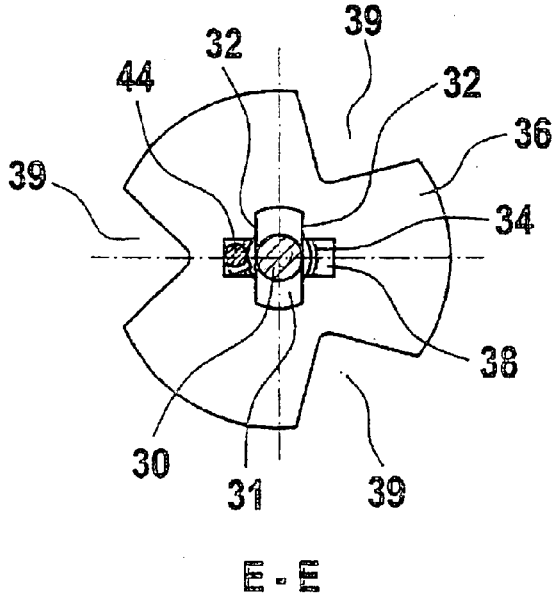
Fig. 4.3

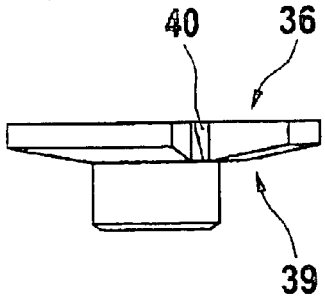
Fig. 6.1
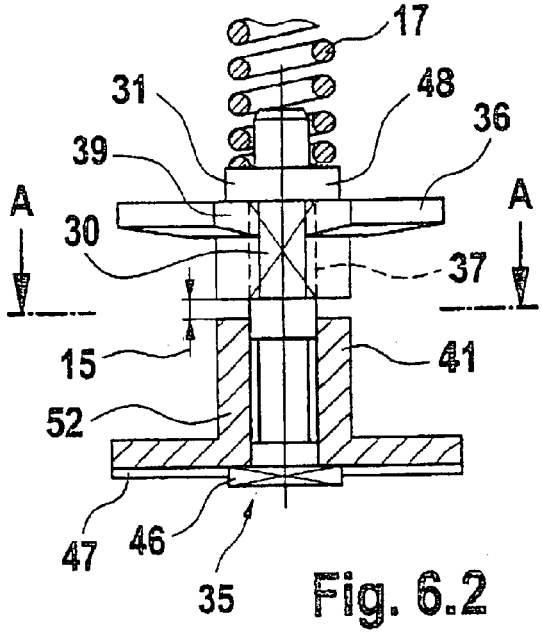
Fig. 6.2
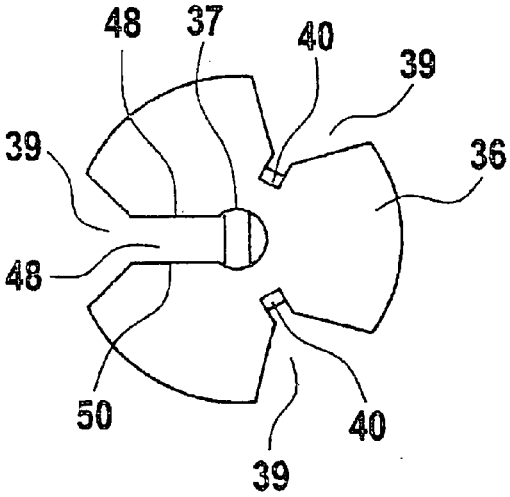
Fig. 6.3
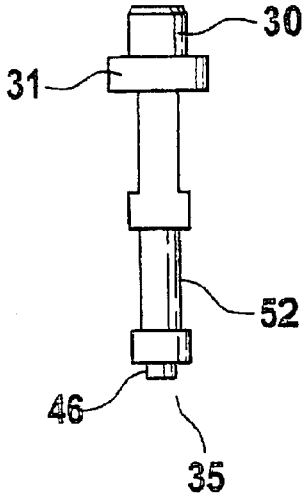
Fig. 6.5
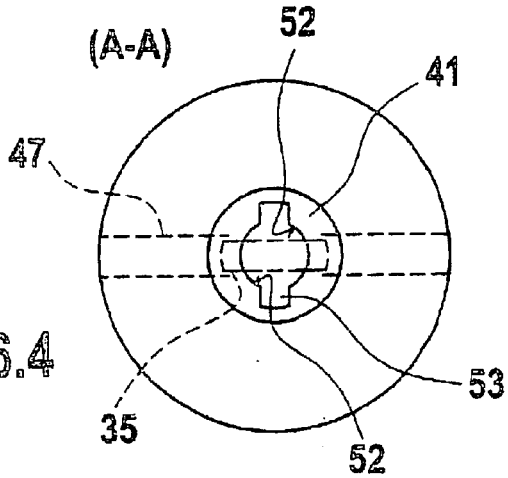
Fig. 6.4

SOLENOID VALVE COMPRISING A PLUG-IN/ROTATIVE CONNECTION

FIELD OF THE INVENTION

Solenoid valves may be used in fuel-injection systems to actuate the fuel injectors. For this purpose, the solenoid valves include an electromagnet set into the injector body, which cooperates with an armature group having an armature pin and armature plate. The armature pin is designed such that it accommodates a closing member, which closes or releases an outlet of a control chamber actuating the nozzle needle of the fuel injector. To obtain a rapidly responding and precise lift movement of the armature group when the electromagnet is energized, a reliable and play-free connection of the armature plate and armature pin is required in the case of two-piece armature groups, or of the armature-guide sleeve and the armature pin in the case of a one-piece armature.

BACKGROUND INFORMATION

German Published Patent Application No. 196 50 865 relates to a solenoid valve whose armature has a plurality of parts. The armature includes an armature plate and an armature pin, which is guided in a sliding block. To prevent post-oscillations of the armature plate following the closing of the solenoid valve, a damping device is formed at the magneto armature. Such a device makes it possible to precisely observe, and reproduce, the required short switching times of the solenoid valve. This solenoid valve is intended for use in injection systems, especially in high-pressure injection systems, such as those having a high-pressure common rail.

The damping device by which post-oscillations of the first armature part during its dynamic displacement are able to be damped includes a first armature part, which has a projection facing in the axial direction which, upon displacement of the first armature part, is able to dip into a stationary recess of the sliding block whose design complements that of the projection. The recess with the projection includes a damping chamber which, via a leakage gap, is in connection with a relief chamber surrounding it.

Alternatively, an annular shoulder which is enclosed by a section of the first armature piece may be situated at the armature pin, and an annular shoulder may likewise be located at the first armature piece. Between the annular shoulder of the armature pin and the annular shoulder of the first armature piece a damping chamber is permanently enclosed, which, in turn, is connected via a leakage gap to a relief chamber surrounding it.

According to this design approach, which utilizes a two-part armature able to be actuated by an electromagnet, a stop ring is inserted between the armature pin and the armature plate. The stop ring is designed in the form of an open retaining disk and has a tendency to wear. Considerable signs of wear may occur, which, on the one hand, may lead to play developing between the armature pin and the armature plate and, on the other hand, to the complete destruction of the retaining disk. Even only play developing between the armature pin and the armature plate adversely influences the volume tolerances in the injection, thereby no longer providing, in particular, a repeat accuracy in injections of the most minuscule quantities implemented in rapid succession.

SUMMARY OF THE INVENTION

The design approach underlying the present invention is characterized by its simplicity and its sturdiness. The installation requires no special tools; in particular, the components of the armature group are able to be precisely adjusted with respect to one another. Positioning an armature guide around the pin-shaped armature piece in an armature having a two-piece design extends the armature guide, thereby obtaining better guidance precision of the pin-shaped armature piece. Increased guidance precision offers advantages in switching operations of the solenoid valve that occur in quick succession at the fuel injector.

Depending on the embodiment variant, two-piece armatures can be preassembled in an uncomplicated manner by using the design approach according to the present invention. In multi-part armatures, a simple and operationally reliable joining of the first armature group may be implemented by using a bayonet lock, for instance. Following preassembly, it is then possible to insert it into an armature guide having guideway sections. The design approach according to the present invention allows securing the components to be joined in their anti-rotation integrity relative to one another by utilizing component-integrated or additional measures. On the one hand, it is possible to insert the section of an elastic armature spring into an opening in which the armature components to be joined are rotated relative to one another. An extension of the elastic armature spring may project into a recess in the armature guide, which is configured as a longitudinal groove, for instance. When using an armature group joined from two components at the fuel injector, it is then ensured that the components, which are rotated and secured with respect to one another, remain in the rotated position, thus guaranteeing a trouble-free operation over a long period of time.

If an armature having a one-piece design is joined to an armature guide using the design approach according to the present invention, a stop face may be formed at the underside of the armature guide with which a stop face provided with flattened regions may engage in the rotated state. The anti-rotation integrity of this variant of an embodiment of the design approach proposed by the present invention results from the fact that the groove depth of a stop face on the armature guide is larger dimensioned than the lift height traveled by the assembled armature group when a discharge valve at the control chamber of the fuel injector is actuated. This ensures that the stop face of the one-piece armature and the underside of the armature guide designed as a groove, for instance, remain engaged at all times and that no relative twisting of the components of one-piece armatures and armature-guide sleeves may occur with respect to one another.

In an additional variant of an embodiment of the design approach proposed by the present invention, an armature plate provided with a slit and an armature pin may be joined to one another in such a way that, if the armature pin includes a region having a tapered diameter, the armature plate having a slit is inserted via the region having the tapered diameter and is then slid upwards onto the armature pin. This is followed by the installation of the armature guide, which is configured as a groove, for instance, onto the region having a tapering diameter. The armature pin is then twisted until its stop face and the groove formed on the armature guide prevent a twisting of the armature guide relative to the preassembled group, which is made up of the armature plate and armature pin.

When using the bayonet design, additional locking element for the armature plate will be unnecessary. The illustrated variants of an embodiment of the design approach according to the present invention all have in common that they are able to be used for armature guideways that are clamped above and beneath a valve-tightening nut.

BRIEF DESCRIPTION OF THE DRAWINGS

FIGS. 2.1 and 2.2 shows an armature pin including a locking element, in a plan view and side view.

FIGS. 3.1 and 3.2 shows the embodiment of an armature plate, in a sectional and plan view.

FIGS. 4.1 through 4.3 shows an armature pin guided in grooves and accommodated in an armature guideway.

FIG. 6.1 shows an armature plate configured with a slit.

FIG. 6.2 shows the detailed view of an assembled armature group.

FIG. 6.3 shows the plan view of a slitted armature plate.

FIG. 6.4 shows the sectional profile A—A according to FIG. 6.2.

FIG. 6.5 shows an armature pin rotated at 90' compared to the view according to FIG. 6.2.

DETAILED DESCRIPTION

Figure 1:
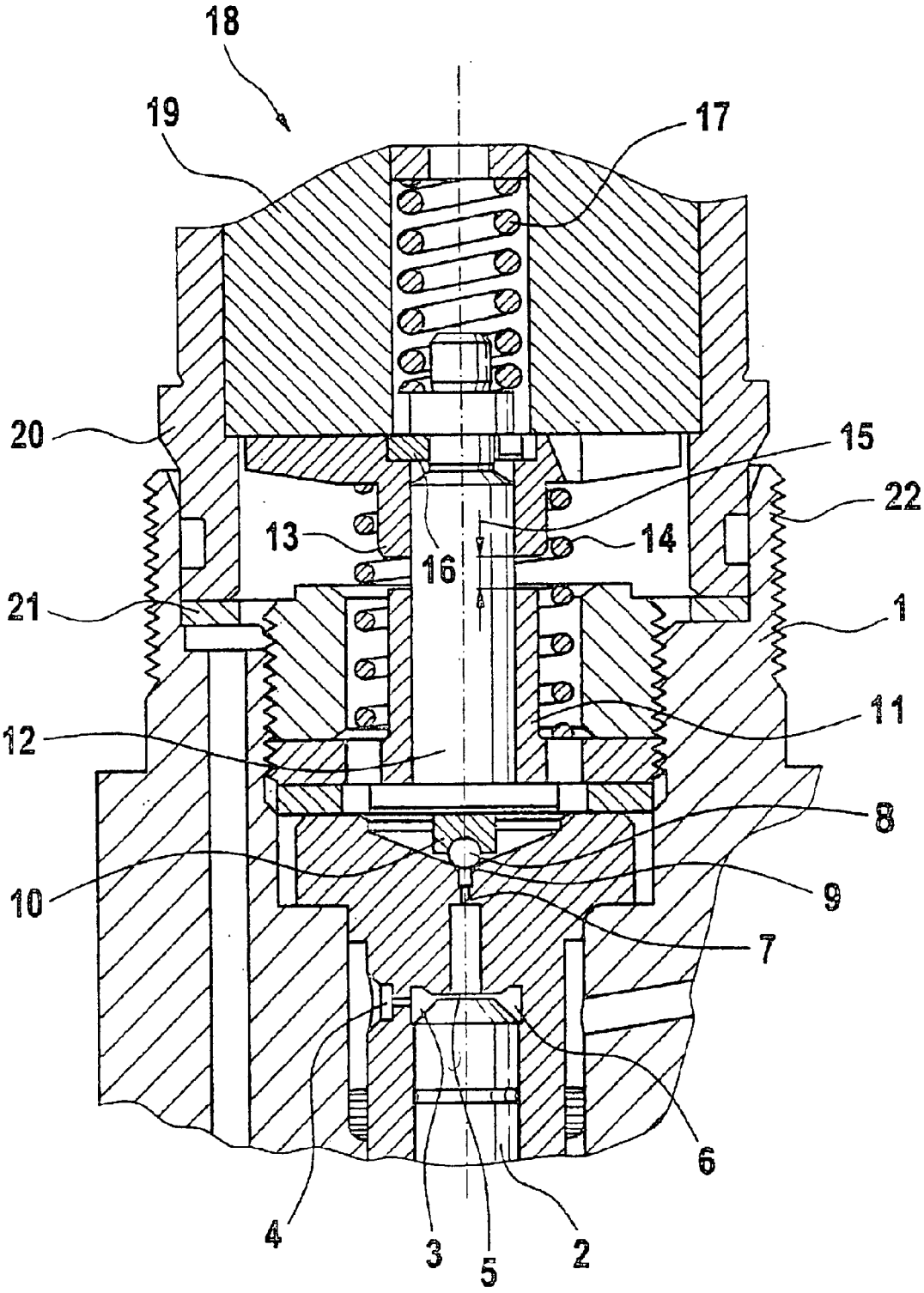
FIG. 1 shows an armature group configured in two pieces, in which the armature plate and the armature pin are joined using a retaining disk.

FIG. 1 shows an armature group having a two-piece design in which the armature plate and armature pin are provided with a retaining disk.

From the drawing according to FIG. 1 it may be inferred that a nozzle needle/tappet system 2 is accommodated in a control chamber 3 provided in injector body 1 of a fuel injector. Via an intake throttle 4, control chamber 3 is acted upon with a control volume, and is able to be biased via a discharge throttle 7 which relieves the pressure in control chamber 3 and may be activated by a closing member 8. An end face of nozzle needle/tappet system 2 projects into control chamber 3 enclosed by a boundary wall 6. Depending on the pressurization or the pressure relief of control chamber 3, nozzle needle/tappet system 2 projecting into control chamber 3 by its end face 5 is imparted with a vertical movement within injector body 1 during which injection orifices (not shown here) of the fuel injector at the combustion chamber of the internal combustion engine are either opened or closed.

FIG. 1 shows closing member 8, which is able to be actuated by a solenoid valve 18, positioned in its valve seat 9; closing member 8 is surrounded by a molded member 10, which is connected to armature group 12, 13.

Furthermore, it can be inferred from the representation according to FIG. 1 that armature pin 12 of armature group 12, 13 is enclosed by a pin guide 11, which is held inside injector body 1 of the fuel injector with the aid of a screw nut. The two components 12 and 13 of the armature having a multi-piece configuration are prestressed with respect to one another via a bias element 14. Bias element 14 is configured as a helical spring, a gap 15 being adjusted between sliding block 13 and armature pin 12. A recess, into which a retaining ring 16 is inserted, is provided in the upper region of sliding piece 13. According to this variant of an embodiment, retaining ring 16 is acted upon with a valve spring 17, which penetrates an electromagnet 19 of solenoid valve 18 in a bore. Retaining ring 16, which is open at one end, has a tendency to wear in this design approach. The disadvantage of this design, in particular, is that more pronounced manifestations of wear may appear which, in the extreme case, may even result in the destruction of retaining disk 16.

It should be mentioned for the sake of completeness that a solenoid sleeve 20 is formed at electromagnet 19 of solenoid valve 18. Solenoid sleeve 20 is supported on an adjustment disk 21 inserted into a bore of injector body 2. An external thread 22 is provided at the outside of injector body 2 by which a solenoid tightening nut, which has a matching internal thread, holds electromagnet 19 and, thus, solenoid valve 18, in a fixed position at injector body 1.

FIGS. 2.1 and 2.2 show an armature pin having a locking element, in a plan view and in a side view, respectively.

From the plan view according to the representation in FIG. 2.1 it can be gathered that the armature pin includes a stop face 35 having an annular configuration, which has a diameter that is larger than armature-pin diameter 33. Reference numeral 34 denotes the surface area of the armature bolt. A projection 31 having surfaces 32 is accommodated at the armature pin as well. Projection 31 is dimensioned such that it extends beyond surface area 34 of the pin-shaped armature part on both sides.

From the side view of armature pin 30 according to FIG. 2.2 it can be inferred that armature pin 30 has been produced with a pin diameter 33. Projection 31 having surfaces 32 formed thereon has an approximately rectangular design. Joined to projection 31 at armature pin 30 is an area having a tapering diameter, which may be provided, for instance, with an external thread.

FIGS. 3.1 and 3.2 show a sectional view and a plan view of an armature plate, respectively. From the sectional view according to FIG. 2.1 it may be gathered that armature plate 36 includes a central bore 37. Central bore 37 is encircled by an opening 38 having an approximately rectangular configuration, whose dimensions correspond to the dimensions of projection surface 31, having surfaces 32 formed thereon, on armature pin 30.

From the plan view of the armature plate according to FIG. 3.2 it may be inferred that the circumference of armature plate 36 is provided with cutouts 39 having an approximately triangular configuration. Bore 37 in armature plate 36 transitions into an opening 38 having a rectangular configuration, by which a preassembled armature group is produced when armature pin 30 is joined by insertion and twisting. Viewed in the radial direction, triangularly configured cutouts 39 at the circumference of armature plate 36 end in individual slots 40.

The drawings according to FIGS. 4.1 through 4.3 show a pre-assembled armature group having a two-piece configuration; it is enclosed in the lower region by an armature guide 41 having guide segments.

For instance, the drawing according to FIG. 4.1 shows a pre-assembled armature group made up of armature pin 30 and armature plate 36. In the view according to FIG. 4.1, projection 31 at armature pin 30 is twisted in such a way that its surfaces 32 run perpendicularly to the drawing plane. As already mentioned, projection 31 ends in a threaded section which is enclosed by a valve spring 17 in the representation according to FIG. 4.1. Beneath armature plate 36, armature pin 30 is encircled by an armature guide 41. Armature guide 41 rests on the annularly extending stop face 35 of armature pin 30. Viewed from the longitudinal direction, armature guide 41 is provided with sections 42 and 43, which extend in the form of grooves. These are a first guide groove 42 and a second guide groove 43. As can be gathered from the drawing according to FIG. 4.1, second groove 43 extending in the longitudinal direction is used to accommodate an armature spring which functions as anti-rotation element 44. The armature spring extends through opening 38 (not shown in FIG. 4.1), which has an essentially rectangular design (cf. representation according to FIG. 4.3).

FIG. 4.2 shows a longitudinal section through the pre-assembled armature group, armature guide 41 not being shown for reasons of representation.

Valve spring 17, which acts upon armature plate 36, is braced against the upper end face of projection 31. Surfaces 32 of projection 31 can be seen in the view according to FIG. 4.2. Anti-rotation element 44, designed as an armature spring, for instance, extends in parallel to bore 37 of the armature plate, whose rectangular form corresponds to the rectangular form of projection 31 of armature pin 30 having surfaces 32.

From the plan view according to the representation in FIG. 4.3, an armature group, joined from armature pin 30 and armature plate 36, may be gathered. It has been preassembled in a manner that prevents twisting. For the mounting of armature pin 30 and armature plate 36, projection 31 formed at armature pin 30 and opening 38 surrounding bore 37 of armature plate 36 are in true alignment with each other, making it possible to insert armature pin 30 through armature plate 36. Armature plate 36 having opening 38 formed therein is then rotated relative to projection 31 of armature pin 30, and an anti-rotation element in the form of an armature spring is inserted into opening 38. The armature spring projects into one of longitudinal grooves 42 and 43, respectively, of armature guide 41 which, in drawing 4.3, are covered by armature plate 36, however. Anti-rotation element 44, configured as an armature spring, prevents twisting of armature-pin projection 31 and opening 38 of armature plate 36 with respect to each other. As a result, the pre-assembled armature group stays joined as such at all times.

Figure 5:
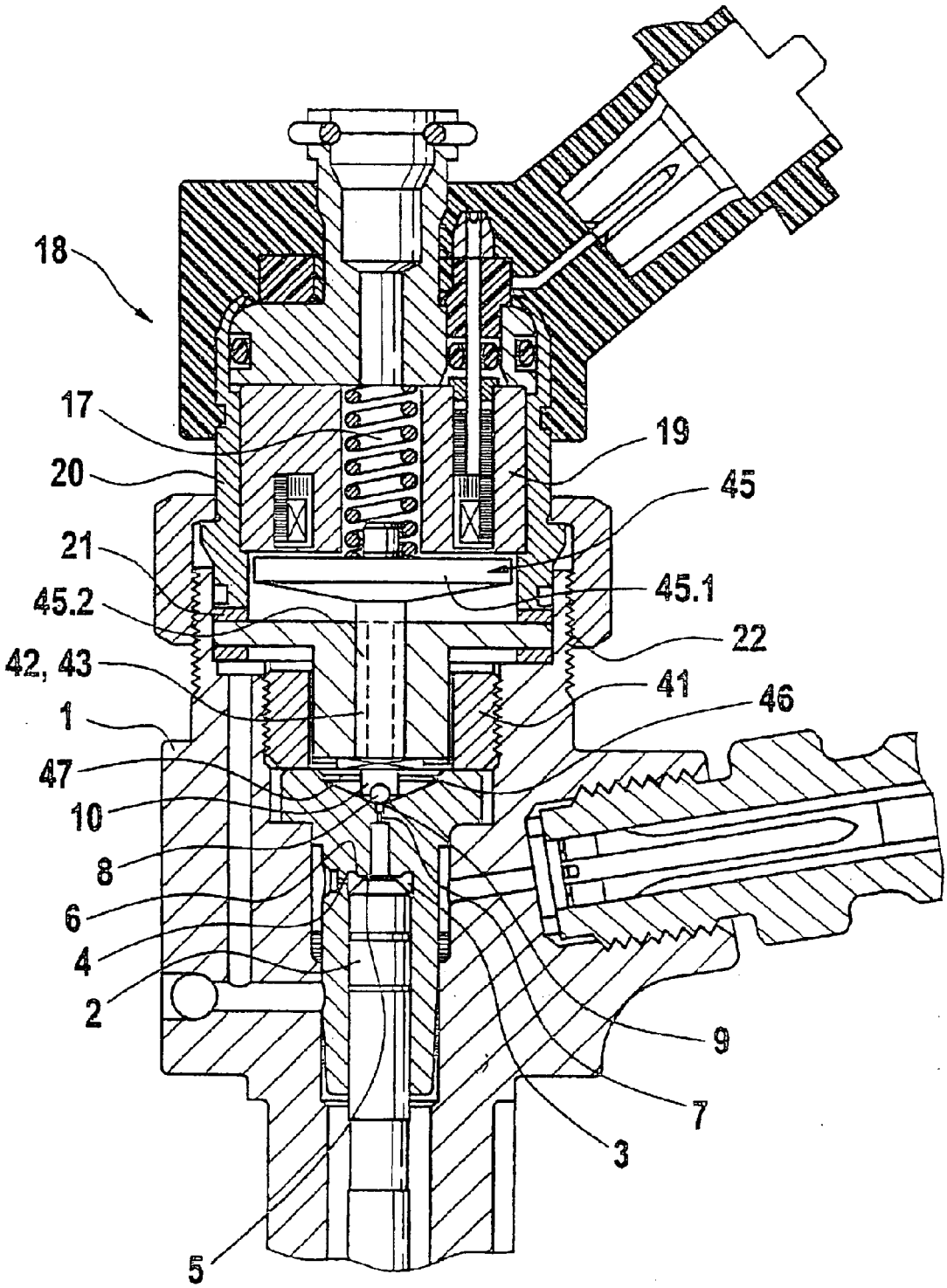
FIG. 5 shows an armature having a one-piece configuration, which is encircled by a grooved armature guideway and has a bayonet lock at its lower end.

FIG. 5 shows an armature having a one-piece design, which is enclosed in an injector housing by a grooved armature guide.

Accommodated in injector body 1 of a fuel injector, analogously to the representation according to FIG. 1, is a nozzle needle 2 which projects into a control chamber 3 of injector body 1. Analogously to the variant known from the related art, nozzle needle/tappet system 2 is able to be actuated in the vertical direction in injector body 1 via the pressure prevailing in control chamber 3. A pressure build-up in control chamber 3 is implemented by an inlet throttle element 4, whereas a pressure relief of control space 3 is implemented by an actuable discharge throttle 7. Discharge throttle 7 is closed with the aid of a closure member 8, which, according to the variant of an embodiment of the design approach according to FIG. 5, is accommodated in a molded member 10 at an armature 45 having a one-piece design. Above armature 45 having a one-piece configuration is an electromagnet 19 of solenoid valve 18, which includes a solenoid sleeve 20 supported on an adjustment disk 21 on armature guide 41. Analogously to the variant of an embodiment known from the related art, an exterior thread is provided at the outside of injector body 1 onto which a solenoid tightening nut is threaded. Solenoid sleeve 20 surrounding electromagnet 19 of solenoid valve 18 is held on injector body 1 with the aid of the solenoid tightening nut.

A valve spring 17, extending through electromagnet 19 in a central bore, acts upon one-piece armature 45. In this armature design, one-piece armature 45 includes an armature plate 45.1 which transitions into a pin section 45.2. Section 45.2 of armature 45 having a one-piece configuration extends in the form of a pin and is enclosed by an armature guide 41, which is braced inside injector body 1. Armature guide 41 may be provided with longitudinal grooves 42 or 43, these grooves representing the guideway sections in which armature 45 having a one-piece design is able to be guided in its up-and-down movement in the vertical direction inside injector body 1 when solenoid valve 18 is activated.

At the underside of armature guide 41 is a stop face in the form of a groove 47. This groove 47 is used as a stop face for a flattened region 46, which is formed on pin-shaped section 45.2 of one-piece armature 45 in the manner of a bayonet lock. Situated beneath flattened region 46 is the already mentioned molded member 10, which surrounds closure member 8 by which discharge throttle 7 of control chamber 3 is closed.

One-piece armature 45 represented in FIG. 5 is joined to armature guide 41, which surrounds it, in such a way that one-piece armature 45 is first rotated so as to align flattened region 46 with the bore of armature guide 41, which, in a rotational position, has a design that makes it possible to slip armature guide 41 over pin section 45.2 of one-part armature 45. After armature guide 41 has been slipped on, it is twisted until flattened region 46 engages with stop face 47 formed on the armature guide.

According to this variant of an embodiment of a one-piece armature 45, an anti-rotation element is provided in that the depth of stop face 47 in the lower region of armature guide 41 has a larger dimension than the height of lift which armature 45, having a one-piece configuration, travels in armature guide 41 in response to solenoid valve 18 being actuated. In this way, flattened region 46 will never be in an operating state where it does not engage with stop face 47 formed in the lower region of armature guide 41.

It should be mentioned for the sake of completeness that inlet throttle 4, which acts upon control chamber 3 with a control volume in the interior of injector body 1, is acted upon via a fuel intake into which a filter element has been inserted and which discharges in injector body 1 at a slant.

The drawing according to FIG. 6.1.

The drawing according to FIG. 6.1 shows a slotted armature plate.

Along its circumference, armature plate 36 shown in FIG. 6.1 is provided with one or a plurality of cutouts 39 which have a triangular shape. At their end extending radially towards the line of symmetry of armature plate 36 (cf. representation according to FIG. 3), cutouts 39 include a slot 40.

The drawing according to FIG. 6.3 shows a plan view of armature plate 36 according to FIG. 6.1. Armature plate 36 includes a bore 37 which ends via a slot-shaped opening 48 in triangularly-shaped cutout 39. A first contact surface 49 and a second contact surface 50 of opening 48 extending in the form of a slot are dimensioned such that the gap separating them is less than the diameter of bore 37. The two remaining triangularly-shaped cutouts 39, formed at the periphery of armature plate 36, are likewise provided with slots 40 on their respective side facing bore 37, analogously to the representation of armature plate 36 according to FIG. 3.2.

FIG. 6.2 provides the detailed view of a pre-assembled armature group.

According to this variant of an embodiment using the design approach of the present invention, armature pin 30, in the region in which it is enclosed by armature plate 36 after being joined thereto, has a first diameter that corresponds to the diameter of bore 37 of armature plate 36. In the lower region of armature pin 30, this diameter transitions into a region having a tapered diameter. When assembling the armature group, armature plate 36 having slot 48 is first slipped over the region having a tapered diameter, and then pushed upward in the direction of stop 31 of armature pin 30 so as to abut against it. This assembly step is followed by the mounting of armature guide 41, which is provided with a stop face, configured as groove 47, in its lower region. In the manner of a bayonet lock, armature guide 41 is first rotated at armature pin 30 so as to be aligned with stop face 46. Then, armature guide 41 is slipped over the region of armature pin 30 having a tapered diameter.

Formed at armature guide 41 are internal guideway sections 52 which surround the region of armature pin 30 having a tapered diameter.

The design approach for joining armature plate 36, armature pin 30 and armature guide 41, using the bayonet lock shown in FIG. 6.2, is able to protect this pre-assembled group from twisting, without this requiring additional locking elements. It need only be ensured, for instance, by installing a bias element between armature plate 36 and the end face of armature guide 41, that flattened regions 46 always remains in contact with the wall of lower groove 47 at armature guide 41. Using spring element 14, components 36 and/or 41 are able to be kept at a distance from one another by a gap, denoted by reference numeral 15, at armature pin 30.

FIG. 6.4 shows the sectional profile A—A according to the representation in FIG. 6.2.

It can be inferred from this drawing that armature guide 41 includes inner groove sections 53 formed on its internal guide. When armature pin 30 is assembled, it is rotated in such a way that its stop face 35 is able to be guided by inner groove sections 53 of armature guide 41. Subsequently, armature pin 30 is rotated in such a way that stop face 35, having flattened regions 46 formed thereon, is rotated at approximately 90° relative to inner guide sections 53, as shown in the drawing of FIG. 6.4. Flattened regions 46 of stop face 35 thereby abut against lower groove 47 of armature guide 41.

FIG. 6.5 shows armature pin 30 with projection 31 formed thereon in a position that is rotated by 90° compared to its mounted position in FIG. 6.2. Compared to the position of armature pin 30 shown in FIG. 6.2, it is rotated in such a way in the representation according to FIG. 6.5 that flattened regions 46 at stop face 35 run perpendicularly to the drawing plane. In this position, the armature pin with armature plate 36 accommodated therein is able to be guided by the inner guide sections 53 of armature guide 41 and, thus, is able to be mounted. Since the groove depth of lower groove 47 is larger dimensioned than the height of lift of the assembled armature group, a protection against twisting of the armature pin relative to the armature guide during the operation is ensured at all times.

What is claimed is:

1. A solenoid valve for a fuel injector for injecting a fuel into a combustion chamber of an internal combustion engine, comprising:

an electromagnet arranged in an injector body of the fuel injector;

an armature group including a first armature part and a second armature part, wherein:

the armature group is capable of being actuated by the electromagnet, the armature group is capable of relieving a pressure in a control chamber, the armature group is capable of moving a nozzle needle/tappet system in the injector body, the first armature part includes a platelike armature part, and the second armature part includes a pin-shaped armature part;

an insert-and-twist connection by which the platelike armature part and the pin-shaped armature part are joined to one another; and an armature guide including guideways and by which one of the platelike armature part and the pin-shaped armature part is enclosed.

2. The solenoid valve as recited in claim 1, wherein:

the armature guide includes guideway sections extending in a longitudinal direction of the pin-shaped armature part.

3. The solenoid valve as recited in claim 2, wherein:

the guideway sections include longitudinal grooves.

4. The solenoid valve as recited in claim 1, wherein:

the pin-shaped armature part includes a stop face at an end of the pin-shaped armature part facing the control chamber.

5. The solenoid valve as recited in claim 1, further comprising:

a valve spring for acting upon the armature group in a closing direction, wherein:

the armature group includes at an end thereof facing the control chamber a molded member that surrounds a closing member.

6. The solenoid valve as recited in claim 1, further comprising:

a projection including projection surfaces and being formed on the pin-shaped armature part.

7. The solenoid valve as recited in claim 6, wherein:

the platelike armature part includes an opening having a shape that corresponds to that of the projection.

8. The solenoid valve as recited in claim 7, further comprising:

an anti-rotation element for securing the pin-shaped armature part and the platelike armature part, the anti-rotation element extending through the opening and being accommodated in one of the guideways.

9. The solenoid valve as recited in claim 1, wherein:

the first armature part and the second armature part are formed as a one-piece armature, the pin-shaped armature part corresponds to a pin-shaped section of the one-piece armature, and a flattened region is formed at an end of the pin-shaped section.

10. The solenoid valve as recited in claim 9, wherein:

the flattened region abuts against a groove of the armature guide surrounding the pin-shaped section.

11. The solenoid valve as recited in claim 10, wherein:

a depth of the groove is dimensioned larger than a height of lift of the one-piece armature in the injector body.

12. The solenoid valve as recited in claim 1, wherein:

the pin-shaped armature part includes a section having a smaller diameter that corresponds to a gap between a first contact area and a second contact area of an opening in the platelike armature part.

13. The solenoid valve as recited in claim 12, wherein:

with respect to the first armature part and the second armature part, a connection in the manner of a bayonet lock is formed between a groove of the armature guide and a flattened region of the pin-shaped armature part.

14. The solenoid valve as recited in claim 1, further comprising:

a bias element situated between the platelike armature part and the armature guide.

15. The solenoid valve as recited in claim 1, wherein:

the first armature part and the second armature part are formed as a one-piece armature, and the platelike armature part corresponds to a platelike armature section of the one-piece armature, the solenoid valve further comprising a bias element situated between the platelike armature section and the armature guide.

* * * * *